US005239741A

United States Patent [19]

Shamos

[11] Patent Number: 5,239,741

[45] Date of Patent: Aug. 31, 1993

[54] METHOD OF FABRICATING A PILLOW CASING APPARATUS

[76] Inventor: Desmond E. Shamos, 8205 Via De La Escuela, Scottsdale, Ariz. 85258

[21] Appl. No.: 936,257

[22] Filed: Aug. 27, 1992

[51] Int. Cl.[5] ..... B21D 53/00; B65B 39/00; B65B 25/20

[52] U.S. Cl. ..... 29/521; 72/379.2; 493/379; 53/390

[58] Field of Search ..... 493/379, 390, 84, 88; 29/521; 72/379.2, 379.4; 53/456, 458, 459, 469, 260, 390

[56] References Cited

U.S. PATENT DOCUMENTS

| | | | |
|---|---|---|---|
| 845,205 | 2/1907 | Stokes | 493/379 X |
| 1,722,734 | 7/1929 | Coghlan et al. | 53/260 |
| 2,445,548 | 7/1948 | Wiepert | 72/379.4 |
| 2,521,196 | 9/1950 | Whetzell | 53/260 |
| 2,555,584 | 6/1951 | Fairbank | 53/469 X |
| 3,019,833 | 2/1962 | Reardon | 72/379.4 X |
| 3,362,529 | 1/1968 | Gant et al. | 53/456 X |
| 3,381,810 | 5/1968 | Lasher et al. | 53/456 X |
| 3,878,802 | 4/1975 | Schmitt et al. | 72/379.4 X |
| 4,037,778 | 7/1977 | Boyle | 53/390 X |
| 4,628,661 | 12/1986 | St. Louis | 72/379.2 X |
| 4,749,011 | 6/1988 | Rylander | 53/390 X |
| 4,805,592 | 2/1989 | Enami | 29/521 X |
| 4,884,603 | 12/1989 | Simpson | 53/390 X |
| 5,095,685 | 3/1992 | Latham | 53/390 X |

*Primary Examiner*—Horace M. Culver
*Attorney, Agent, or Firm*—Jordan M. Meschkow; Lowell W. Gresham; Don J. Flickinger

[57] ABSTRACT

A pillow tray having a back panel, sidewalls, and an endwall to which a retaining member is hingedly attached defining a pillow opening for holding a pillow neatly so as to be easily inserted into a pillowcase.

5 Claims, 4 Drawing Sheets

FIG. 12
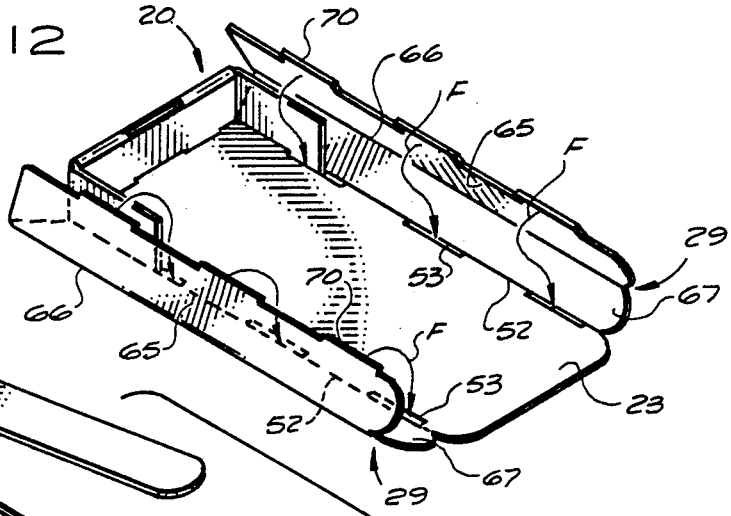
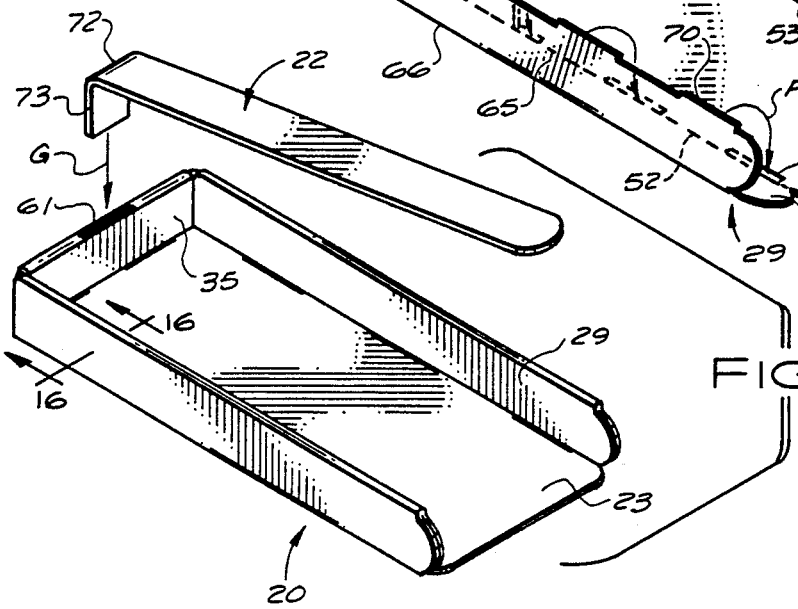
FIG. 13
FIG. 14
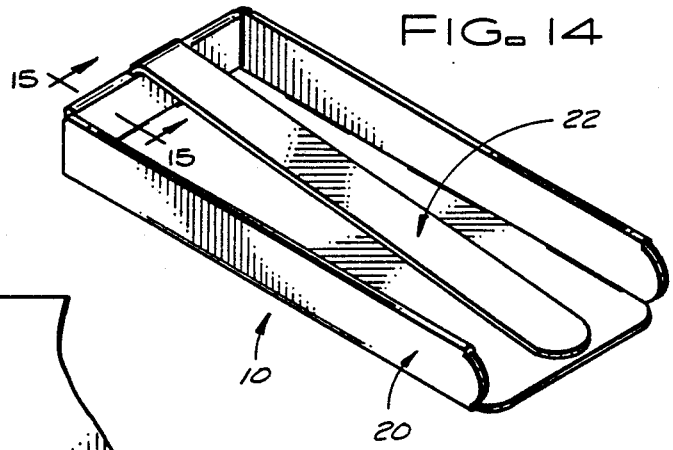
FIG. 15
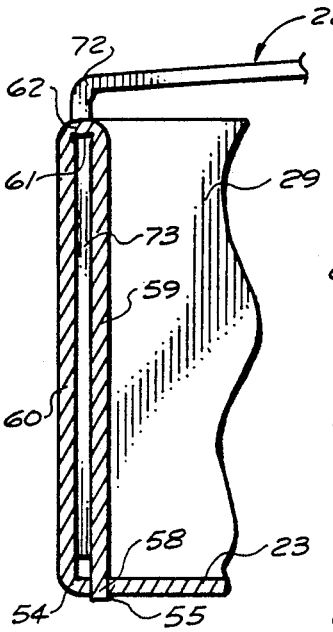
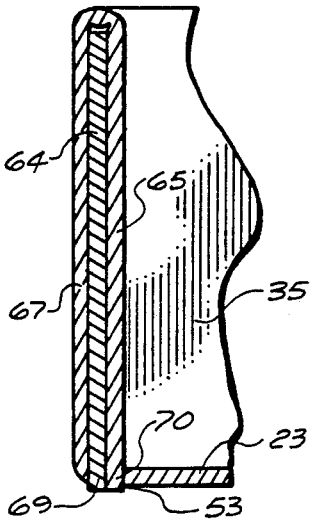
FIG. 16

METHOD OF FABRICATING A PILLOW CASING APPARATUS

BACKGROUND OF THE INVENTION

1. Field of the Invention

This invention relates to housekeeping apparatus.

More particularly, the present invention relates to aids in preparing bedding.

In a further and more specific aspect, the instant invention concerns a method and apparatus for inserting a pillow into a pillowcase.

2. Prior Art

When referring to bedding, the list of elements are incomplete without including pillows. Generally a pillow is considered a necessity for comfortable sleeping. A pillow is relatively expensive, but will last for a considerable length of time if protected from wear and tear. Therefore, as with other bed linens, pillowcases are to protect the pillow, and also to be decorative.

Pillowcases are generally sack-like, having an open-end to receive a pillow. The pillowcase encloses the pillow protecting it from being soiled and worn from use. Pillows are frequently removed from pillowcases allowing the pillowcases to be replaced or washed. In some cases, such as a hotel environment, pillowcases are changed frequently.

Traditionally, to insert a pillow into a pillowcase, an end of the pillow is held under a persons chin. The open-end of the pillowcase is then fitted over the opposing end of the pillow. From this position, the pillowcase can be pulled upward, enclosing the pillow. This has been a successful technique, used for many years. While this method of incasing a pillow is relatively simple, some people may have difficulties due to their size, strength or agility.

Many pillows, such as pillows used on king sized beds are relatively long and may be difficult to handle for one who is older or smaller.

Many times a pillow is difficult to force into a pillowcase. Instead of sliding easily into the case, application of force to overcome friction between he pillow and pillowcase is required. This may distort the pillow as well as cause difficulty for a great number of people. When a small pillow is being cased, care can be taken in order to smooth or straighten corners. However, even with small pillows this may be difficult. With larger pillows inserting a pillow into a case can result in turning or compressing the corners, distorting the shape of the pillow. Thus the cased pillow does not have a neat look with distinctive corners.

It would be highly advantageous, therefore, to remedy the foregoing and other deficiencies inherent in the prior art.

Accordingly, it is an object of the present invention to provide a new pillow casing apparatus.

Another object of the present invention is to provide a pillow casing apparatus that is inexpensive.

And another object of the present invention is to provide a pillow casing apparatus that is easy to use.

Still another object of the present invention is to provide a pillow casing apparatus which can be used to easily and neatly insert a pillow into a pillowcase.

Still another object of the instant invention is to provide a pillow casing apparatus which is simple to construct.

Yet another object of the present invention is to provide a pillow casing apparatus which may be built with dimensions to accommodate substantially any pillow size.

Yet still another object of the present invention is to provide a pillow casing apparatus which will allow the insertion of a pillow into a pillowcase so as to keep the corners of the pillow distinct.

SUMMARY OF THE INVENTION

Briefly, to achieve the desired objects of the instant invention in accordance with a preferred embodiment thereof, provided is a back panel from which an endwall and two sidewalls extend. A retaining member hingedly extends from said endwall spaced apart from the back panel intermediate the sidewalls.

The method of using the pillow casing device includes hingedly swinging the retaining member away from the back panel, and placing the pillow upon the back panel surrounded by the sidewalls and endwall. The retaining member is then moved inward to a position substantially parallel to the back panel, retaining the pillow therebetween. The pillow casing apparatus with pillow is inserted into a pillowcase, and the pillow casing apparatus removed leaving the pillow encased.

BRIEF DESCRIPTION OF THE DRAWINGS

The foregoing and further and more specific objects and advantages of the instant invention will become readily apparent to those skilled in the art from the following detailed description of the preferred embodiment thereof taken in conjunction with the drawings, in which:

FIGS. 11 and 12 illustrate the folding of the tray member illustrated in FIG. 9;

FIG. 13 illustrates the attachment of the retaining member to the pillow tray;

FIG. 14 illustrates a perspective view illustrating the completion of the pillow casing apparatus;

FIG. 15 is a partial cutaway side view taken along line 15—15 of FIG. 14; and FIG. 16 is a partial cutaway end view taken along line 16—16 of FIG. 13.

DETAILED DESCRIPTION OF THE PREFERRED EMBODIMENT

Figure 1:
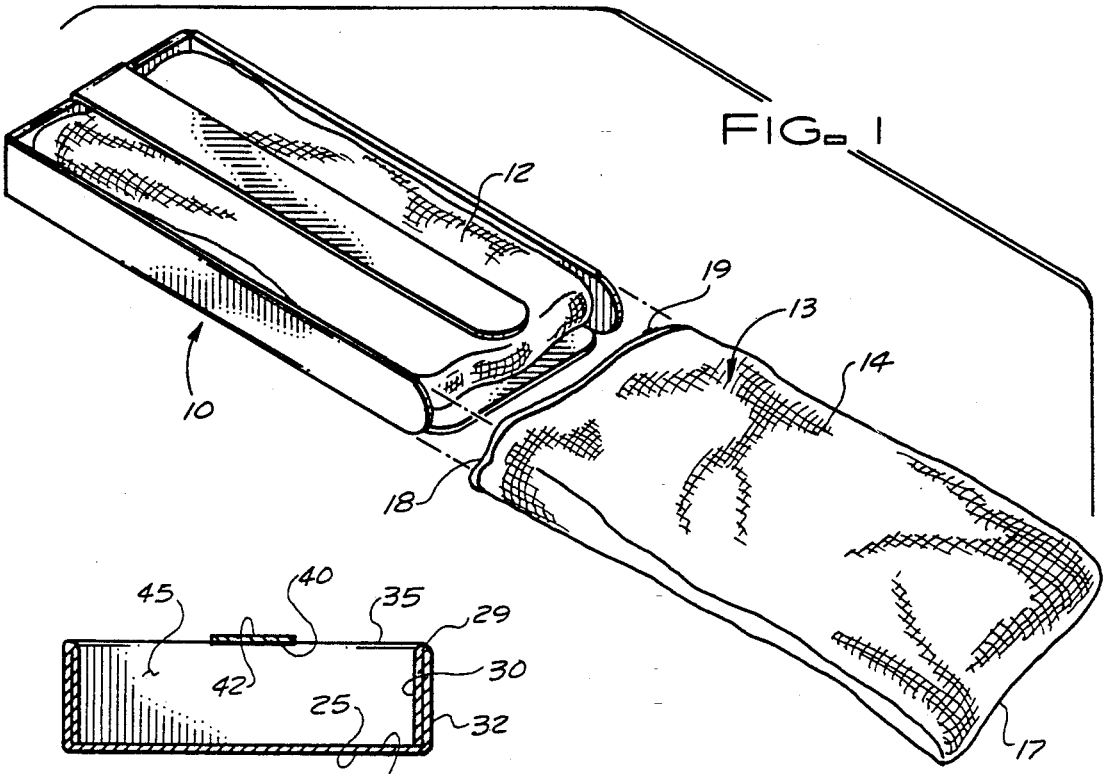
FIG. 1 is a perspective view illustrating the insertion of a pillow casing apparatus containing a pillow being inserted into a pillowcase.

Turning now to the drawings in which like reference characters indicated corresponding elements throughout several views, attention is first directed to FIG. 1 which illustrates a pillow casing apparatus generally designated 10 holding a pillow 12 in preparation for insertion into a pillowcase 13. Pillow 12 is any conventional pillow generally of the type associated with bedding materials and rectangular in shape. Pillowcase 13 is any conventional pillowcase which will receive pillow 12, and is generally a tubular body 14 having a generally rectangular shape, and defining a cavity 15. Tubular body 14 includes a closed-end 17 and an open-end 18. Open-end 18 has a pillow opening 19 which allows access to cavity 15.

Figure 3:
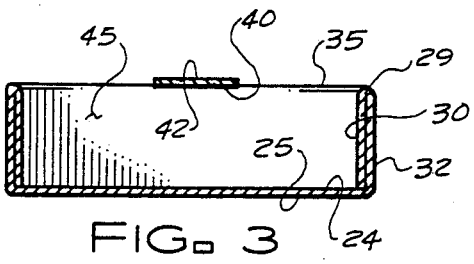
FIG. 3 is a cross-sectional end view taken along line 3—3 of FIG. 2.
Figure 2:
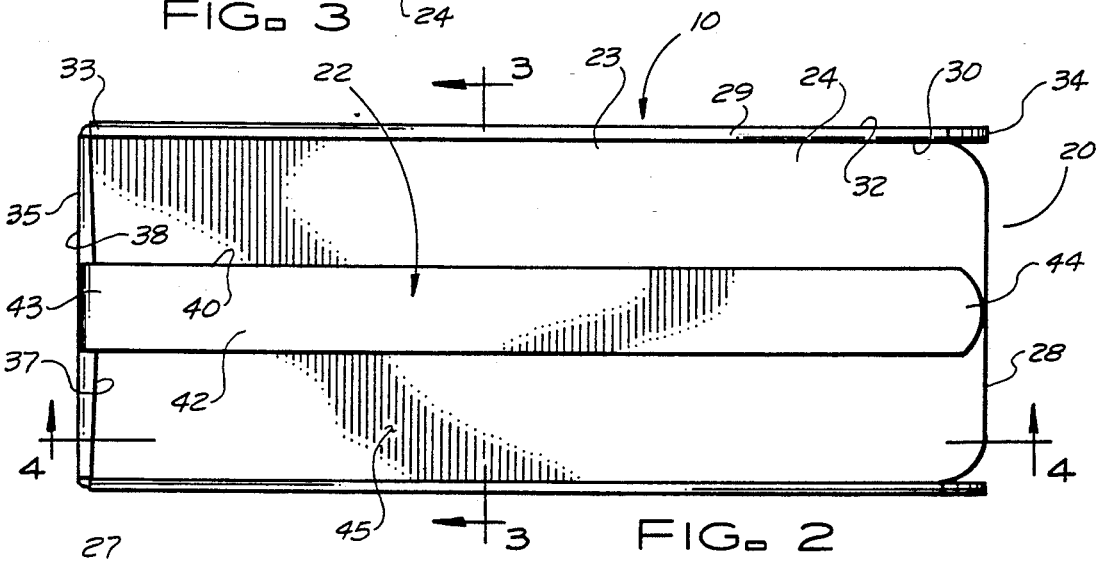
FIG. 2 is a top view of a pillow casing apparatus constructed in accordance with the teachings of the instant invention.
Figure 4:
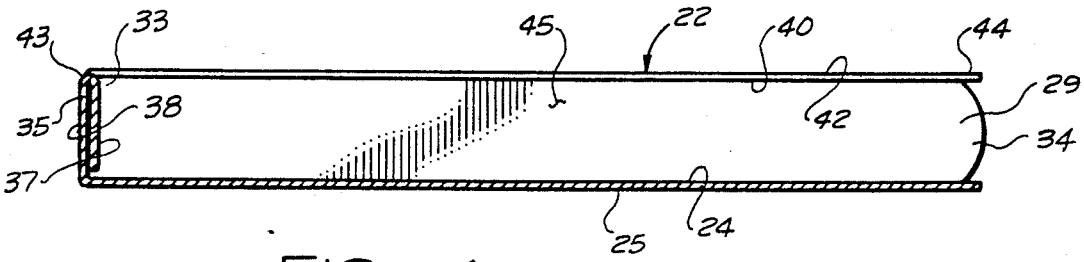
FIG. 4 is a cross-sectional side view taken along line 4—4 of FIG. 2.

Referring to FIGS. 2–4, pillow casing apparatus 10 consists of a pillow tray 20 and a retaining member 22. Pillow tray 20 has a substantially plainer back panel 23 having an inner surface 24 and outer surface 25, a trailing end 27 and a leading end 28. It will be understood that the use of the terms trailing and leading are used solely for purposes of orientation and reference, with leading referring to a portion which is first inserted into pillowcase 13 and trailing referring to a portion following. Sidewalls 29 each having an inner surface 30 an outer surface 32 a trailing end 33 and a leading end 34, extend perpendicularly upward from inner surface 24 of back panel 23 in a parallel spaced apart relationship extending from trailing end 27 to leading end 28 of back panel 23. An endwall 35 having an inner surface 37 and an outer surface 38 extends perpendicularly upward from inner surface 24 of back panel 23 approximate trailing end 27. Endwall 35 is coupled to and extends between trailing ends 33 of sidewalls 29.

Retaining member 22 having an inner surface 40, an outer surface 42, a trailing end 43 and a leading end 44 extends from endwall 35 at trailing end 27 of back panel 23 towards leading end 28 of back panel 23. Trailing end 43 of retaining member 22 is hingedly coupled to endwall 35 allowing retaining member 22 to pivot in an arcing path towards and away from back panel 23. A pillow space 45 is defined between sidewalls 29, endwall 35, back panel 23, and retaining member 22.

Figures 5, 6, 7, 8:
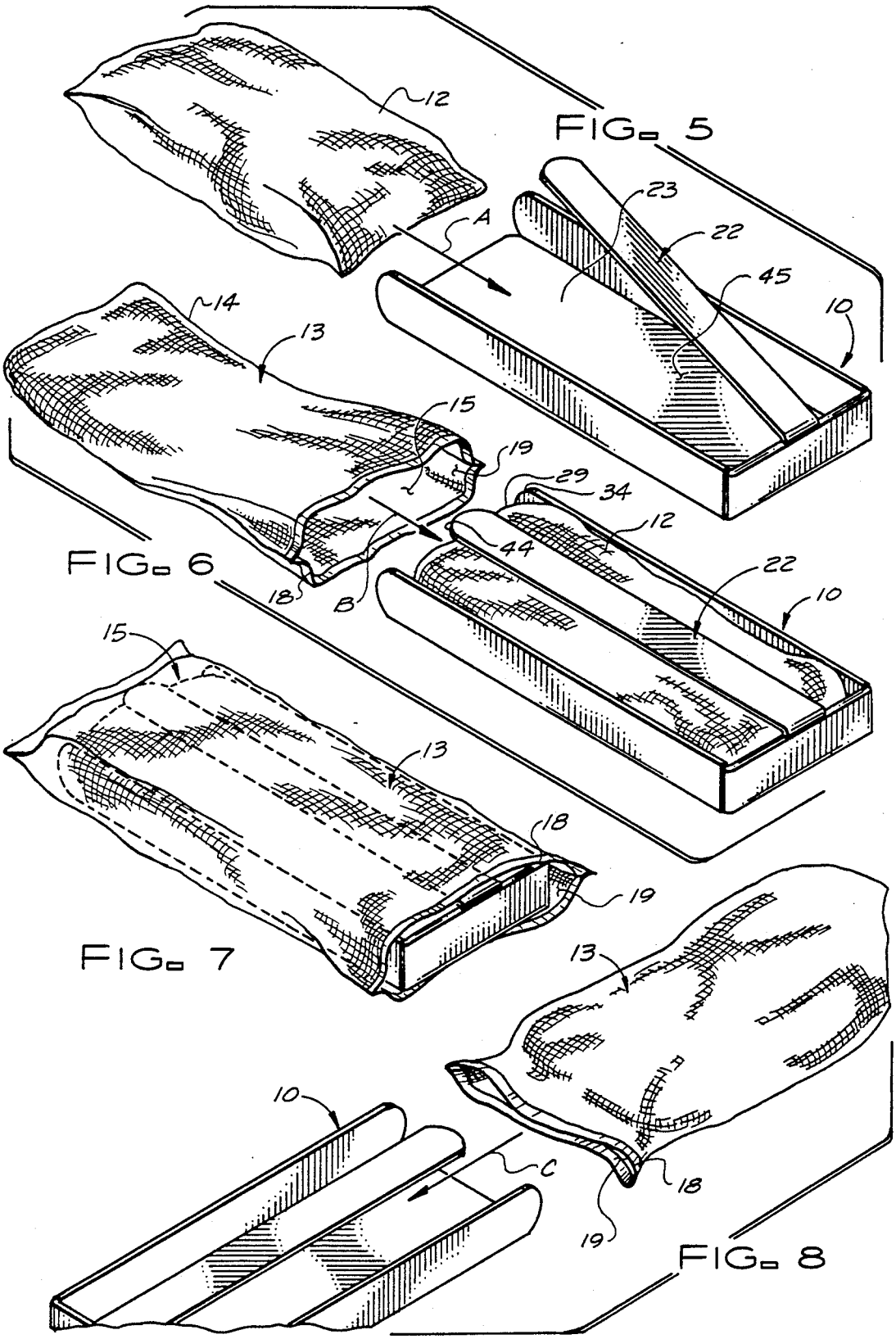
FIGS. 5-8 are perspective views illustrating the casing of a pillow using the pillow casing apparatus.

Referring now to FIGS. 5–8 the method of inserting a pillow into a pillowcase is illustrated. FIG. 5 illustrates retaining member 22 pivoted outward away from back panel 23 to allow easy access to pillow space 45. Pillow 12 is placed into pillow space 45 along arrow A. Retaining member 22 is then pivoted downward towards back panel 23 flattening and retaining pillow 12 as illustrated in FIG. 6. Pillowcase 13 is then pulled onto pillow casing apparatus 10, holding pillow 12, along arrow B. This is accomplished by placing open-end 18 over leading ends 28, 34, and 44 of pillow casing apparatus 10. Pillow casing apparatus 10 is then fully inserted into pillow cavity 15 of pillow case 13 as illustrated in FIG. 7.

The preferred method of accomplishing the steps illustrated in FIGS. 6 and 7 is to place a pillow casing apparatus 10 containing pillow 12 on a flat surface with outer surface 38 of endwall 35 resting thereon. Back panel 23 and sidewalls 29 extend upward away from the flat surface, allowing pillowcase 13 to be fitted over pillow casing apparatus 10. Pillowcase 13 containing pillow casing apparatus 10 and pillow 12 is then reversed, with open-end 18 facing in an upward direction. Pillow casing apparatus 10 is then removed from pillow cavity 15 through pillow opening 19 along arrow C illustrated in FIG. 8. Use of pillow apparatus 10 for casing of pillows 12 insures a smooth pillow and crisp pointed corners which add to the esthetics of the cased pillow.

Those skilled in the art will understand that while pillow casing apparatus 10 is most easily inserted into pillowcase 13 by the method described above, pillow casing apparatus 10 may be inserted in any manner, such as with outer surface 25 of back panel 23 parallel to a surface. As pillow casing apparatus 10 is inserted into pillowcase 13, retaining member 22 allows pillowcase 13 to slide smoothly therealong with substantially no friction produced between pillow 12 and pillowcase 13. Leading ends 28, 34, and 44 are rounded to insure smooth insertion of pillow casing apparatus 10 into pillow case 13. The rounded corners prevent any snags or catches, of pillow casing apparatus 10 on pillowcase 13, from disrupting the smooth insertion of pillow casing apparatus 10 into pillowcase 13.

Figure 9:
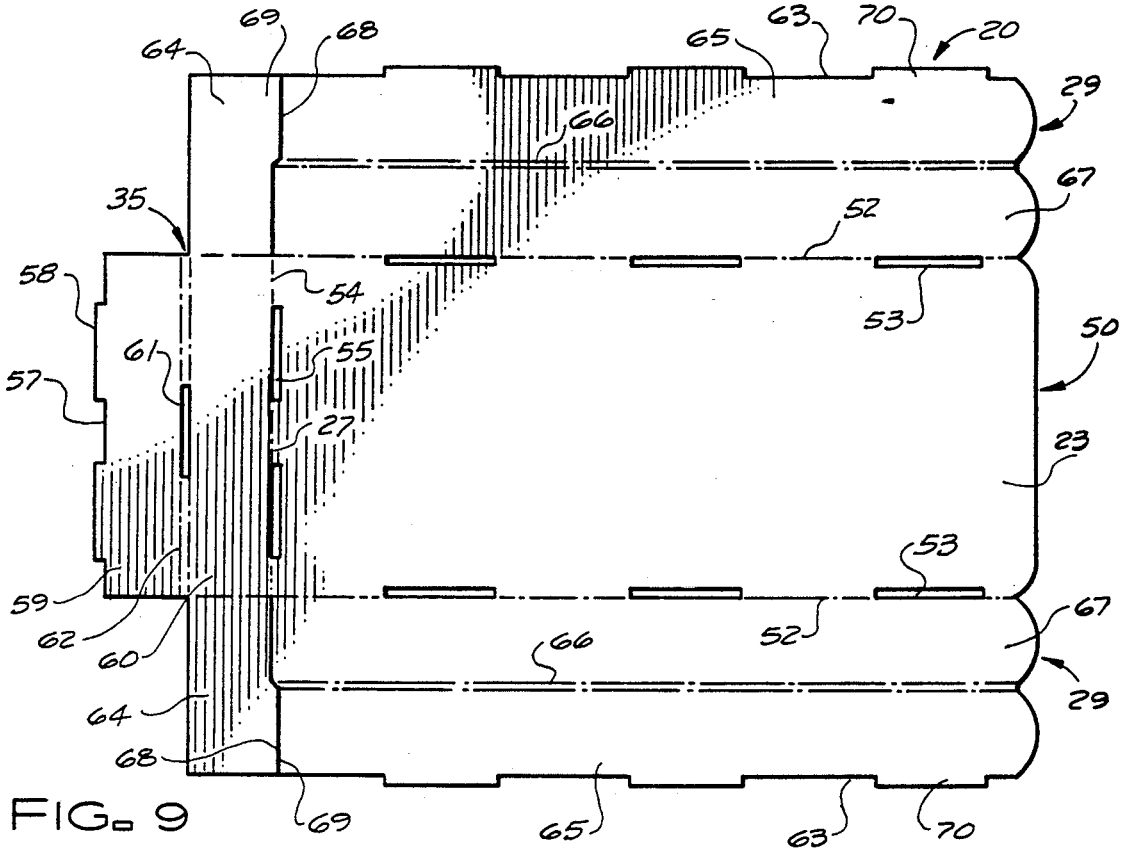
FIG. 9 is a top view illustrating the unfolded pillow tray.

Referring now to FIG. 9, a preferred embodiment for constructing pillow tray 20 is illustrated. Generally, while pillow casing apparatus 10 as described in FIGS. 1–4 may be constructed of various materials such as plastic, cardboard, metal, or various other substantially rigid materials in the finished configuration, the preferred method of construction is illustrated in FIGS. 9–13. For this preferred method of construction, pillow tray 20 further includes a sheet of material 50 consisting of a rigid foldable material such as cardboard or metal. Sheet 50 has a pair of parallel spaced apart perforations 52 defining back panel 23 from sidewalls 29. Slots 53 are formed in sheet 50 along parallel perforations 52. An endwall perforation 54 is formed in sheet 50, defining trailing end 27 of back panel 23 from endwall 35. Endwall slots 55 are formed through sheet 50 along endwall perforation 54. Endwall 35 consists of an edge 57 opposing endwall perforation 54 and having tabs 58 which correspond to endwall slots 55. Endwall 35 is divided into an outer and an inner portion 59 and 60 respectively, by an endwall fold perforation 62 formed in sheet 50 parallel to and intermediate edge 57 and endwall perforation 54. A slot 61 is formed through sheet 50 along endwall fold perforation 62.

Sidewalls 29 include an edge 63 parallel to and spaced apart from parallel perforations 52, a tongue 64, an outer portion 65 and an inner portion 67. Tongues 64 are separated from outer and inner portions 65 and 67 by a separation 68 which is an extension of endwall perforation 54. Tongue 64 is a continuation of and is foldably coupled to inner portion 60 of endwall 35, along parallel perforations 52. Separation 68 is irregular, defining a tab 69 on tongue 64. Outer portion 65 and inner portion 67 are defined by a perforation 66 extending parallel to an intermediate edge 63 and parallel perforations 52. Tabs 70 are formed on edge 63 of outer portion 65, in a spaced apart relationship corresponding to slots 53.

Figure 10:
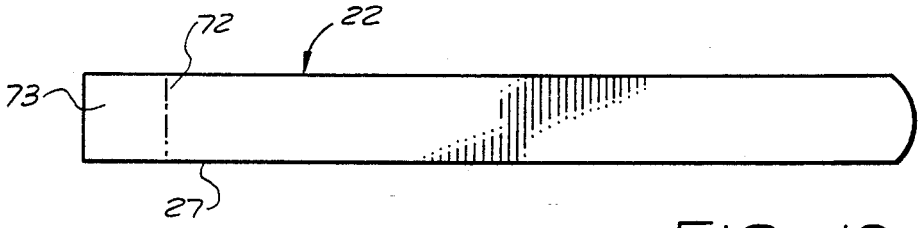
FIG. 10 is a top view illustrating the retaining member of the present invention.

Referring now to FIG. 10, a perforation 72 is formed across retaining member 22 approximate trailing end 27 to form a retainer tab 73.

Figure 11:
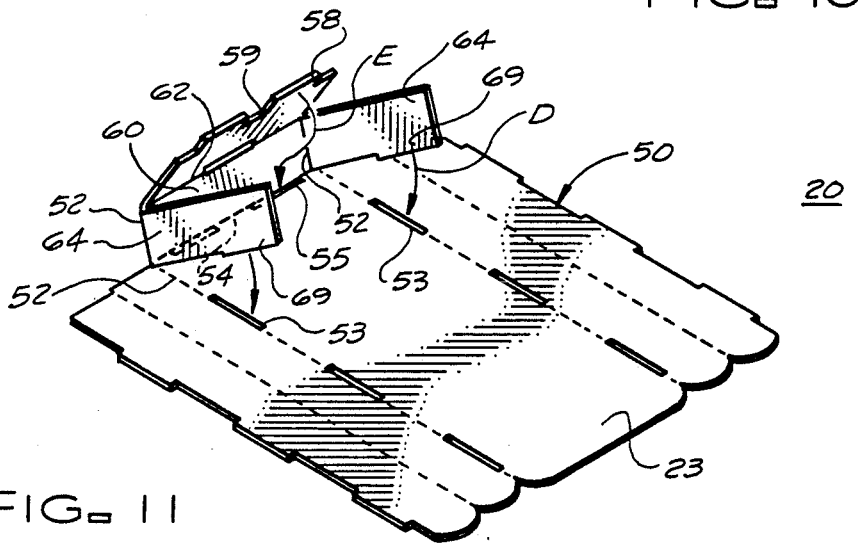

The perforations formed in sheet 50 allow folding thereof to fabricate pillow casing apparatus 10. The steps in this folding process are illustrated in FIGS. 11 and 12. Referring specifically to FIG. 11, tongues 64 are folded perpendicular to inner portion 60 along parallel perforations 52. Inner portion 60 is folded perpendicular to back panel 23 along endwall perforations 54. Slots 53 of back panel 23 receive tabs 69 as inner portion 60 is folded. Tabs 69 follow an arcuate path as illustrated by arrows D. Outer portion 59 is folded downward along endwall fold perforation 62 flush with inner portion 60. Tabs 58 follow an arcuate path designated by the arrow E and are received by endwall slots 55. Details of the endwall construction are illustrated in FIG. 15, and details of the sidewall construction are illustrated in FIG. 16.

Referring now to FIG. 12 and 16, inner portion 67 of sidewalls 29 are folded upwardly perpendicular to back panel 23 along parallel perforations 52. Outer portion 65 is folded inwardly parallel to inner portion 67 along perforations 66 with tabs 70 following a path indicated by arrows F, to be received by corresponding slots 53. This forms the completed pillow tray 20, as can be seen in FIG. 13.

Referring to FIG. 13, retainer tab 73 is folded along perforation 72 to form a flexible hinge. Retaining tab 73 is inserted into slot 61 along a path illustrated by arrow G. The completed pillow casing apparatus 10 is illustrated in FIG. 14.

Various changes and modifications to the embodiment herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

1. A method of fabricating a pillow casing apparatus comprising the steps of:

providing a sheet of material having a back panel, a first sidewall, a second sidewall and an endwall defined by perforations;

folding said endwall upward along said perforations, perpendicular to said back panel;

doubling over an outer portion of said endwall inwardly parallel to an inner portion of said endwall;

coupling said outer portion of said endwall to said back panel;

folding tongues extending from said endwall horizontally inward perpendicular to said endwall and said back panel;

folding said first and said second sidewalls upward along said perforations, perpendicular to said back panel; and attaching a retaining member to said endwall.

2. A method of fabricating a pillow casing apparatus as claimed in claim 1 wherein said step of folding said first and second sidewalls includes the steps of:

doubling over an outer portion of said first and second sidewalls inwardly over said tongues, parallel to an inner portion of said first and second sidewalls; and coupling said outer portion of said first and second sidewalls to said back panel.

3. A method of fabricating a pillow casing apparatus as claimed in claim 2 wherein the step of coupling said outer portion of said endwall to said back panel includes inserting tabs extending therefrom into slots formed in said back panel.

4. A method of fabricating a pillow casing apparatus as claimed in claim 1 wherein the step of coupling said outer portion of said first and second sidewalls to said back panel includes inserting tabs extending therefrom into slots formed in said back panel.

5. A method of fabricating a pillow casing apparatus as claimed in claim 2 wherein the step of attaching said retaining member includes the steps of:

forming a tab at one end of said retaining member by folding an end of said retaining member along a perforation; and inserting said tab into a slot formed in said endwall.

* * * * *